US005385476A

United States Patent [19]

Jasper

[11] Patent Number: 5,385,476

[45] Date of Patent: Jan. 31, 1995

[54] MAGNETIC CIRCUITS FOR COMMUNICATING DATA

[75] Inventor: Kenneth O. Jasper, Charlotte, N.C.

[73] Assignee: Vehicle Enhanced Systems Inc., Rock Hill, S.C.

[21] Appl. No.: 185,295

[22] Filed: Jan. 24, 1994

Related U.S. Application Data

[63] Continuation of Ser. No. 899,617, Jun. 16, 1992, abandoned.

[51] Int. Cl.[6] ..... H01F 15/02

[52] U.S. Cl. ..... 439/38; 336/90; 336/DIG. 2

[58] Field of Search ..... 439/38, 39; 361/17; 336/90, 96, DIG. 2

[56] References Cited

U.S. PATENT DOCUMENTS

| | | | |
|---|---|---|---|
| 2,379,664 | 7/1945 | Stanko | 336/90 |
| 2,483,815 | 10/1949 | Easton | 439/894 |
| 3,154,360 | 10/1964 | Plishner | 439/675 |
| 3,184,703 | 5/1965 | Piscitello et al. | 439/335 |
| 3,387,606 | 6/1968 | Crafts et al. | 336/90 |
| 3,456,245 | 7/1969 | Fujitsubo | 336/DIG. 2 |
| 3,550,682 | 12/1970 | Fowler | 336/DIG. 2 |
| 3,995,209 | 11/1976 | Weston | 336/DIG. 2 |
| 4,030,058 | 6/1977 | Riffe et al. | 336/DIG. 2 |
| 4,038,625 | 7/1977 | Tompkins et al. | 336/DIG. 2 |
| 4,715,012 | 12/1987 | Mueller, Jr. | 364/900 |
| 4,735,461 | 4/1988 | Moller et al. | 303/7 |
| 4,767,181 | 8/1988 | McEowen | 439/107 |
| 4,772,209 | 9/1988 | Muncey | 439/36 |
| 4,838,797 | 6/1989 | Dodier | 439/38 |
| 4,839,531 | 6/1989 | Stemmons et al. | 307/17 |
| 4,897,642 | 1/1990 | DiLullo et al. | 340/825 |
| 4,969,839 | 11/1990 | Nilsson | 439/395 |
| 5,025,253 | 6/1991 | DiLullo et al. | 340/825 |

FOREIGN PATENT DOCUMENTS

| | | | |
|---|---|---|---|
| 52-33092 | 3/1977 | Japan | 439/38 |

OTHER PUBLICATIONS

"Serial Data Communications Between Microcomputer Systems in Heavy Duty Vehicle Applications" Society of Automotive Engineering J1708 Jun. 1987.

"Seven-Conductor Electrical Connector for Truck--Trailer Jumper Cable" Society of Automotive Engineering J560b Sep. 1974.

Society of Automotive Engineering SAE J560 specification.

*Primary Examiner*—Neil Abrams

*Attorney, Agent, or Firm*—Synnestvedt & Lechner

[57] ABSTRACT

Magnetic circuits for communicating data in a tractor and trailer combination. In a preferred embodiment, a connector for interfacing electrical signals between a tractor and trailer which will be connected together such that the tractor pulls the trailer comprises a receptacle interfaced between the tractor/trailer for housing first electrical interface members that carry electrical signals output from the tractor to the trailer and receiving electrical signals output from the trailer to the tractor, a plug connectable to the receptacle for housing second interface members that carry electrical signals output from the trailer to the tractor, and receiving electrical signals output from the tractor to the trailer, a first coil in the receptacle for communicating data from data-producing devices in the tractor to data-receiving devices in the trailer, and for receiving data from the data-producing devices in the trailer, and a second coil in the plug for receiving the data. The magnetic circuits described herein provide efficient and clean electrical signals for digital data communications in a tractor trailer combination. Furthermore, these devices are simple and economical to produce, and are adaptable for the standard J560 connector which already exists in the trucking industry to interface power between the tractor and the trailer.

12 Claims, 12 Drawing Sheets

MAGNETIC CIRCUITS FOR COMMUNICATING DATA

This is a continuation, of application Ser. No. 07/899,617, filed Jun. 16, 1992 and now abandoned.

Field of the Invention

This invention relates generally to data communication. More specifically, this invention relates to methods and apparatus for data communication using magnetic circuits.

BACKGROUND OF THE INVENTION

The trucking industry has for many years utilized tractor/trailer combinations to transport cargo over land to destinations. The tractors and the trailers are mechanically joined together so that the tractor can pull the trailer with its cargo in an efficient and cost effective manner. Additionally, it has been known to provide various other links between the tractor and the trailer to provide required systems with sufficient means to operate within their operating parameters. Thus, hydraulic, pneumatic, electrical and other systems on the tractor/-trailer combination have associated links and lines running therebetween so these systems can operate.

With regard to electrical systems, both the tractor and trailer operate in conjunction in a manner which requires coordination between the electrical components on each to operate the tractor/trailer combination safely and effectively. In order to coordinate such activities and further to bus power between the tractor and trailer, a seven-pin connector has been used by the trucking to accomplish these and other electrical objectives. An example of such a seven-pin connector is illustrated in U.S. Pat. No. 4,969,839, Nilsson the teachings of which are specifically incorporated herein by reference. These seven-pin connectors are well known and have been specified by the Society of Automotive Engineering (SAE) according to the standard number "SAE J560" the teachings of which are also incorporated herein by reference. Thus, those with skill in the art need only ask for an SAE J560 connector from an appropriate manufacturer and the standard seven-pin connector will be delivered.

Each of the pins in the seven-pin connector is a conductor which is adapted to bus an electrical signal between the tractor and the trailer. The signals generally relate to specific electrical subsystems, for example, turn signals, brake lights, flashers, and other devices which require electrical power to function. The seventh pin on the connector is usually an "auxiliary" pin which can be used for specific electrical purposes or applications on individual tractor/trailer combinations.

The trucking industry has not until very recently incorporated sophisticated electrical and electronic systems in tractor/trailer combinations which perform varied tasks that usually involve data manipulation and transmission. Computers, controllers, and computer-type electrical systems have simply not found their way into the tractor/trailer combination in any significant fashion up to now due, in part, to the low level of technological innovation in the trucking industry and further to a lack of governmental or other authoritative impetus which would otherwise force new systems to be installed on tractor/trailers that include sophisticated electronics and data communications.

However, with the advent of new anti-lock braking systems (ABS) for example, and other new systems which promote tractor/trailer safety and enhanced performance, microprocessors have found their way into use in the trucking industry, and specifically in applications involving tractor/trailer combinations, to enhance the performance of these new systems. It is apparent that the use of computers and microprocessors in general in the trucking industry will continue to expand and provide ever increasing capabilities to tractor/trailer combinations in a wide arena of applications.

Along with the sophistication of computer and electronic subsystems comes the requirement of equally sophisticated and versatile data communications between microprocessors and devices which utilize data output from the computers, or which may be controlled by the computers. Thus, it is necessary to develop and implement data communication links and circuits to provide the microprocessors and systems in tractor/-trailer combinations with fast and accurate data communication. This is particularly true when data must be communicated between data producing devices and data receiving devices that may be found both on the tractor and the trailer, and when data must be transmitted between the tractor and the trailer. An example of this type of data communication between the tractor and the trailer is found in an ABS where data about the performance of the brakes on the trailer must be communicated to a computer in the tractor which will further actuate control valves on the trailer to control the ABS's performance.

Unfortunately, the standard seven-pin connector is simply not suited to provide sophisticated data communications between the tractor and the trailer, nor to allow for multiplexing data communication signals between the tractor and trailer. The seven-pin connector has only been used in the past to provide analog electrical signals, particularly power, to low-level, unsophisticated electrical subsystems in the tractor/trailer combination. Yet, the seven-pin connector is an industry standard which is used in virtually every tractor/trailer in service today and so cannot be discarded or ignored when implementing required data links in the tractor trailer combination.

Accordingly, it would be desirable to design a new seven-pin connector with standard SAE J560 requirements, having the capability to provide data communication to a tractor/trailer combination. The new connector should be rugged to survive the hostile trucking environment, and versatile to provide data communications between electronic systems in the tractor and the trailer. Such goals have not heretofore been achieved in the art.

SUMMARY OF THE INVENTION

The foregoing objects and advantages are achieved, and problems solved, with the methods and apparatus described and claimed herein.

In preferred embodiments, a connector for bussing electrical signals between a tractor and trailer is provided. More preferably, the connector comprises receptacle means connected between the tractor and the trailer for bussing first electrical signals between the tractor and the trailer, plug means connectable to the receptacle means for bussing electrical signals through the receptacle means between the tractor and the trailer, and data communication means in the receptacle means for interfacing data from a data producing device in the tractor/trailer combination to a data receiving device in the tractor/trailer combination through the connector.

In still further preferred embodiments, a method for communicating data between data-producing devices and data-receiving devices is provided. The methods more preferably comprise the steps of interfacing a data signal produced from a data-producing device to a first magnetic device and setting up in the first magnetic device a magnetic field corresponding to data in the data signal, communicating the magnetic field corresponding to data in the data signal to a second magnetic device which is adapted to receive the magnetic field and inducing in the second magnetic device a voltage corresponding to the data in the data signal, and bussing the voltage corresponding to the data in the data signal to a data receiving device.

The methods and apparatus described and claimed herein provide efficient and straightforward data communication between data transmitting and receiving devices that may be found on both tractors and trailers. Thus, the devices described herein promote the use of more complex computer driven circuitry in tractor trailer combinations, thereby allowing new tractor-trailer combinations to be more sophisticated and versatile. Such results have not heretofore been achieved in the art.

DETAILED DESCRIPTION OF THE PREFERRED EMBODIMENTS

Connectors provided in accordance with the present invention are particularly useful for the trucking industry. However, it will be recognized that these connectors and magnetic circuits generally can be utilized in any situation where multiplexing of data is necessary. For ease of description here, data communication in accordance with the present invention will be described with reference to tractor/trailer combinations and the trucking industry, but this is not intended to limit the invention to these preferred embodiments or to applications in this industry alone.

Figure 1:
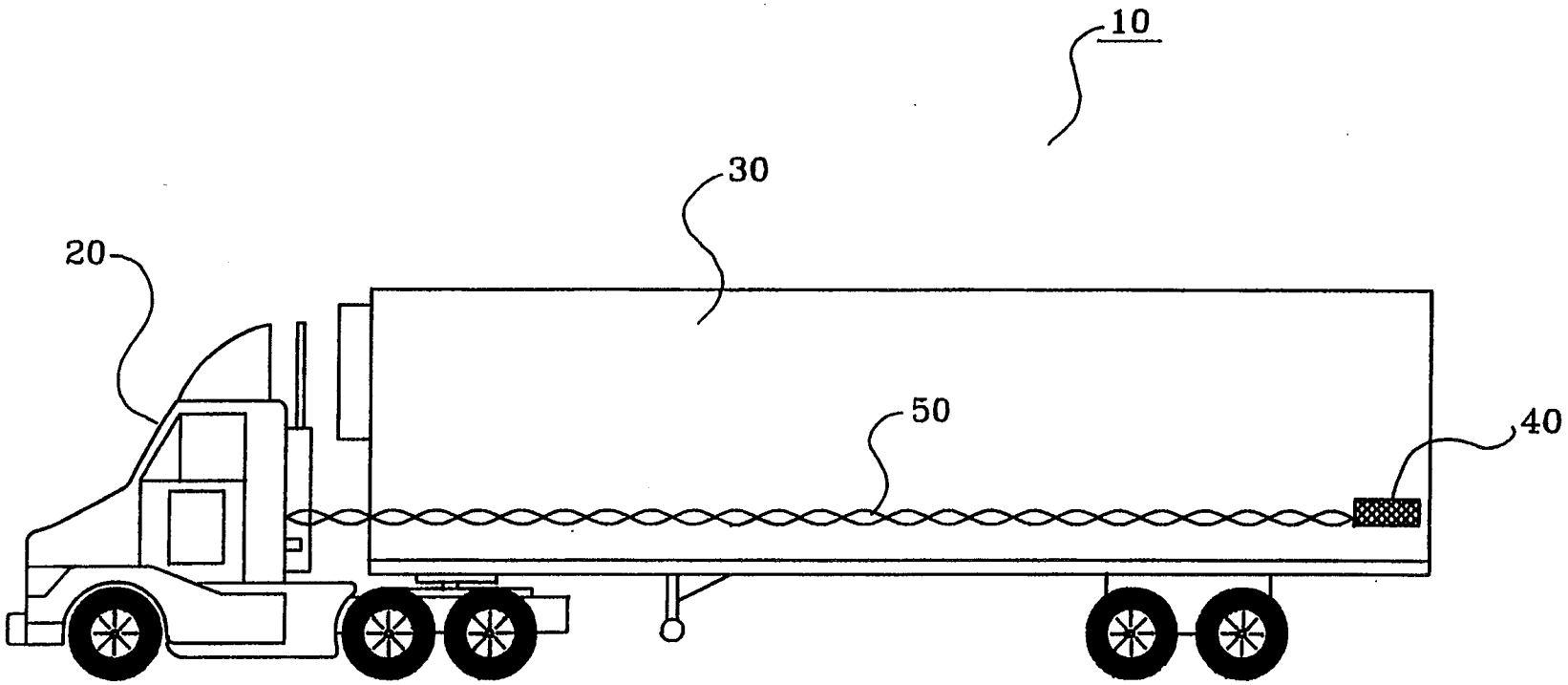
FIG. 1 is a schematic view of a tractor trailer combination utilizing a twisted pair for data communications.

Referring now to the drawings wherein like reference numerals refer to like elements, FIG. 1 shows a tractor trailer combination 10 having data communication devices provided in accordance with the present invention. Tractor/trailer combination 10 comprises a tractor 20 adapted to pull a trailer 30 when the tractor and trailer are connected together in combination. In general, a data-producing or receiving device 40 is found in the trailer 30. Similarly, data-producing or receiving devices (not shown) will be found in the tractor 20 also. Between the data-producing or receiving devices 40 in the trailer or the data-producing or receiving devices in the tractor is a communications line, shown generally at 50, interfacing the two devices together. The data communications line 50 will preferably be interfaced with at least one J560 seven-pin connector which serves in the present embodiment to electrically link the tractor to the trailer for all previous electrical power needs which have heretofore been necessary in a tractor/trailer combination. In accordance with the present invention, the data communications line 50 is also interfaced with the J560 seven-pin connector to provide advanced and sophisticated data communications for the tractor/trailer combination.

Figure 2:
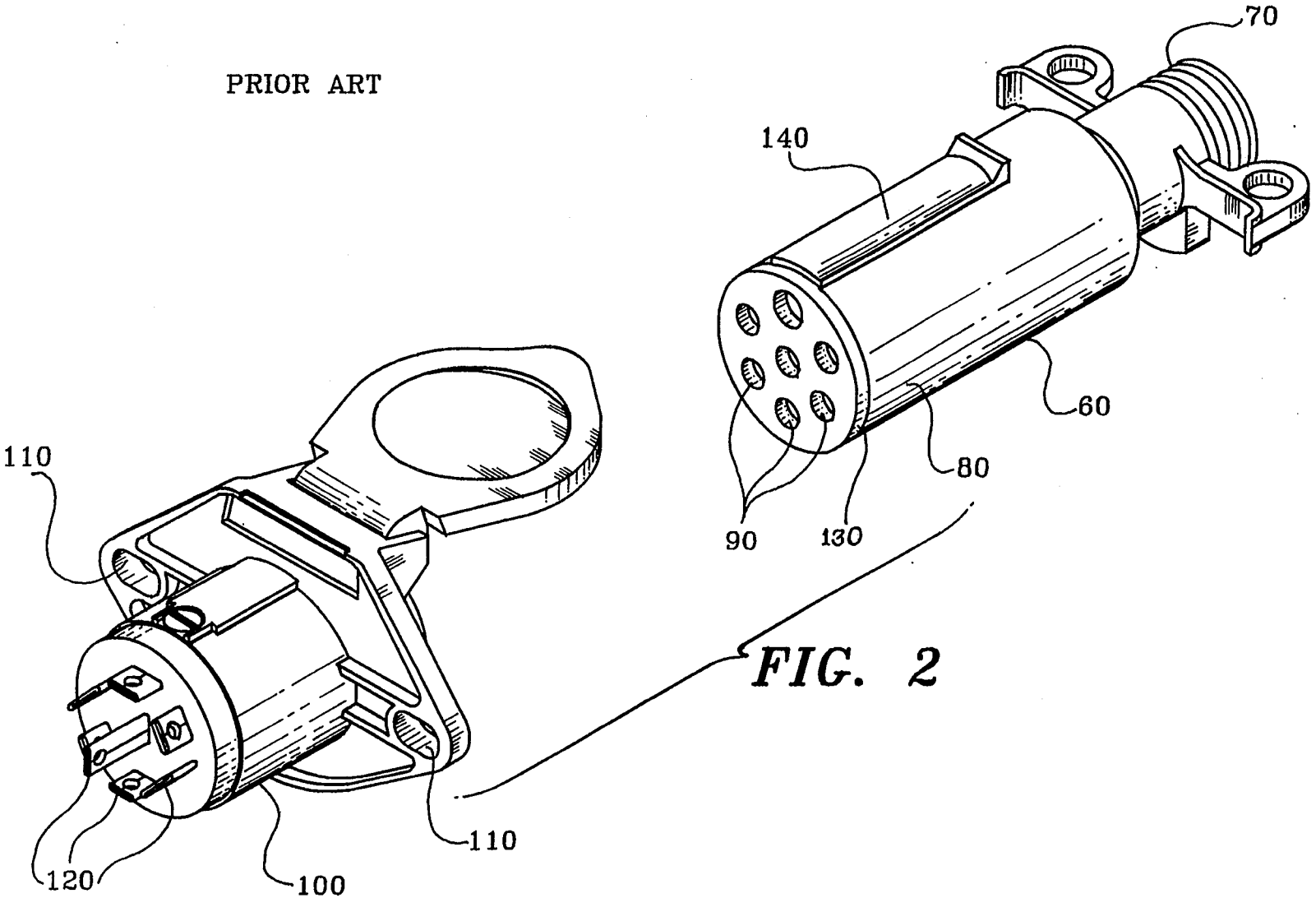
FIG. 2 PRIOR ART
FIG. 2 is an isometric exploded view of a prior art J560 connector.

It will be useful in understanding the present invention to first understand the prior art J560 seven-pin connector as it has been used previously in the trucking industry. FIG. 2 is an isometric view of the two halves of a prior J560 connector which, when joined together, will be mounted on the tractor or the trailer. In this fashion, there may be one J560 connector on the tractor or trailer, but alternately, there may be a J560 connector on the tractor and the trailer with a coiled cable connecting the two J560 connectors together when an application requires such an arrangement. The first half 60 is provided with an end 70 through which electrical power lines are fished and interfaced with connecting elements inside the housing 80 of the first end 60. A plurality of receptacle members 90 mate with and are in electrical communication with the connectors to which the power lines are interfaced, thereby holding the power lines in secure relationship inside the first half 60 of the connector. The J560 connector has seven such receptacles 90.

A second half 100 of the J560 connector in FIG. 2 is adapted to be mounted through holes 110 with the tractor or the trailer. Inside the second half 100, a corresponding plurality of pins (not shown in FIG. 2) are placed which are adapted to interface with the receptacles 90. As can be seen in FIG. 2, a corresponding plurality of terminal ends 120 are attached to the end of the second half 100 so that power can be bussed through the second end 110 through the pins into the receptacles 90 and out through the power lines which have been fished through the end 70.

In operation of the seven-pin connector of FIG. 2, the first and second halves 60 and 100 are joined together with a frictional fit so that the pins are placed substantially deeply into receptacle 90. In order to secure the first and second halves together, the first half 60 is provided with a recessed substantially circular mating end 130 which interfaces with a corresponding circular securing member in the second half 100 (not shown in FIG. 2). The mating protrusion serves mainly as a key so that the first half is not pushed into the second half when the pins and receptacles are not aligned. To further secure the first and second halves of the seven-pin connector together, a mating protrusion 140 is integrally formed on the first half 60 and fits in a receiving passage in the second piece 100 (also not shown in FIG. 2). The mating protrusion 140 and a receiving passage are constructed so that a frictional engagement securely holds the first half 60 to the second half 100 of the seven-pin connector. A spring-loaded lid 150 is usually provided to the second half 100 so that when the first and second pieces are not mated together, lid 150 is closed over the pins in the second half 100 to protect them from a harsh environment and further aiding in holding the first and second halves together.

Figure 3B:
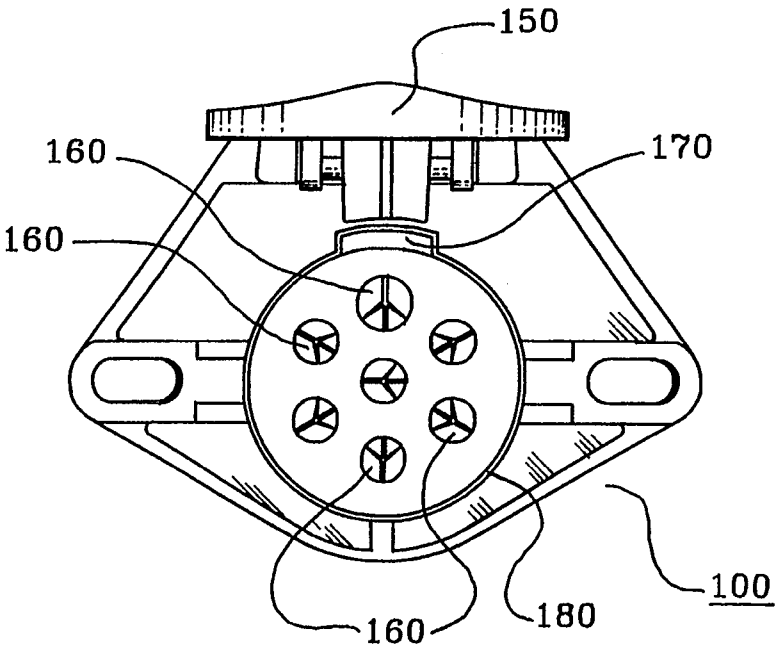
FIGS. 3A and 3B are elevational views of the two pieces of the prior art J560 connector of FIG. 2.
Figure 3A:
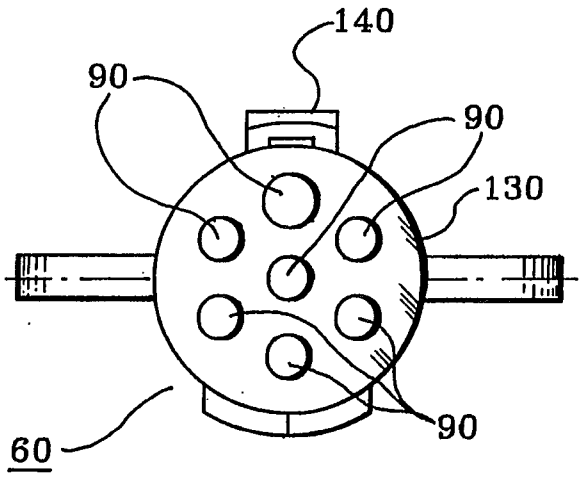
FIG. 3A PRIOR ART

FIGS. 3A and 3B illustrate the inner parts of the J560 prior art seven-pin connector. As best seen in FIG. 3B, the corresponding plurality of pins 160 are configured to interface with the receptacles 90. Furthermore, the receiving passage 170 and substantially circular mating end 180 serve to mate respectively with the mating protrusion 140 and substantially circular mating end 130 to hold the seven-pin connector together.

Figure 4:
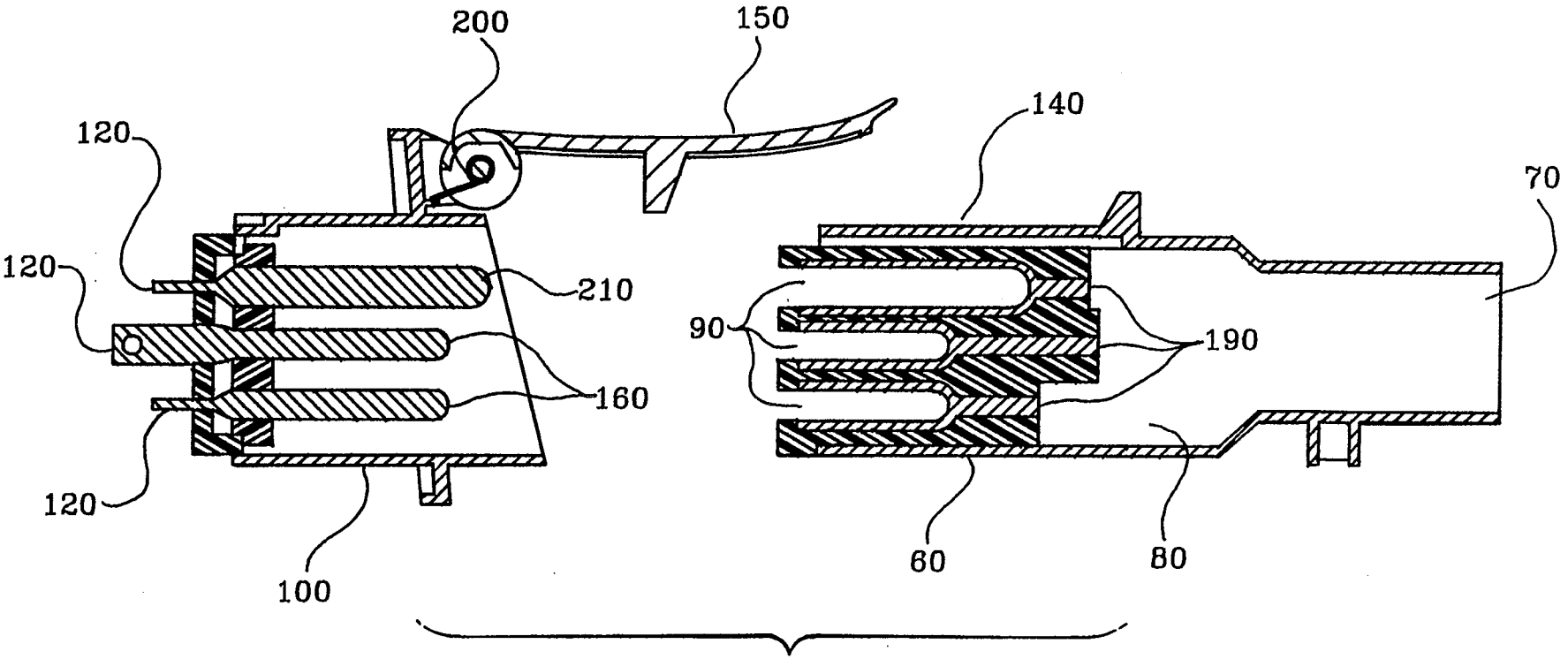
FIG. 4 PRIOR ART
FIG. 4 is a cross-sectional view of the prior art J560 connector shown in FIG. 3.

FIG. 4 is a cross-sectional view of the first half 60 and second half 100 of the prior J560 seven-pin connector. In this view, the connector ends 190 are shown which receive the power lines fed through end 70 in first half 60. Additionally, a spring 200 which controls the action of lid 50 to protect pins 160 is clearly shown. Contacts 190 preferably surround the receptacles 90 so that good electrical connection between receptacles 90 and pins 160 is made when the first half 60 and the second half 100 are mated together. As discussed above, one of the pins 160 is usually an "auxiliary" pin which may or may not be used in a particular tractor/trailer combination to carry power between the tractor/trailer.

Figure 5:
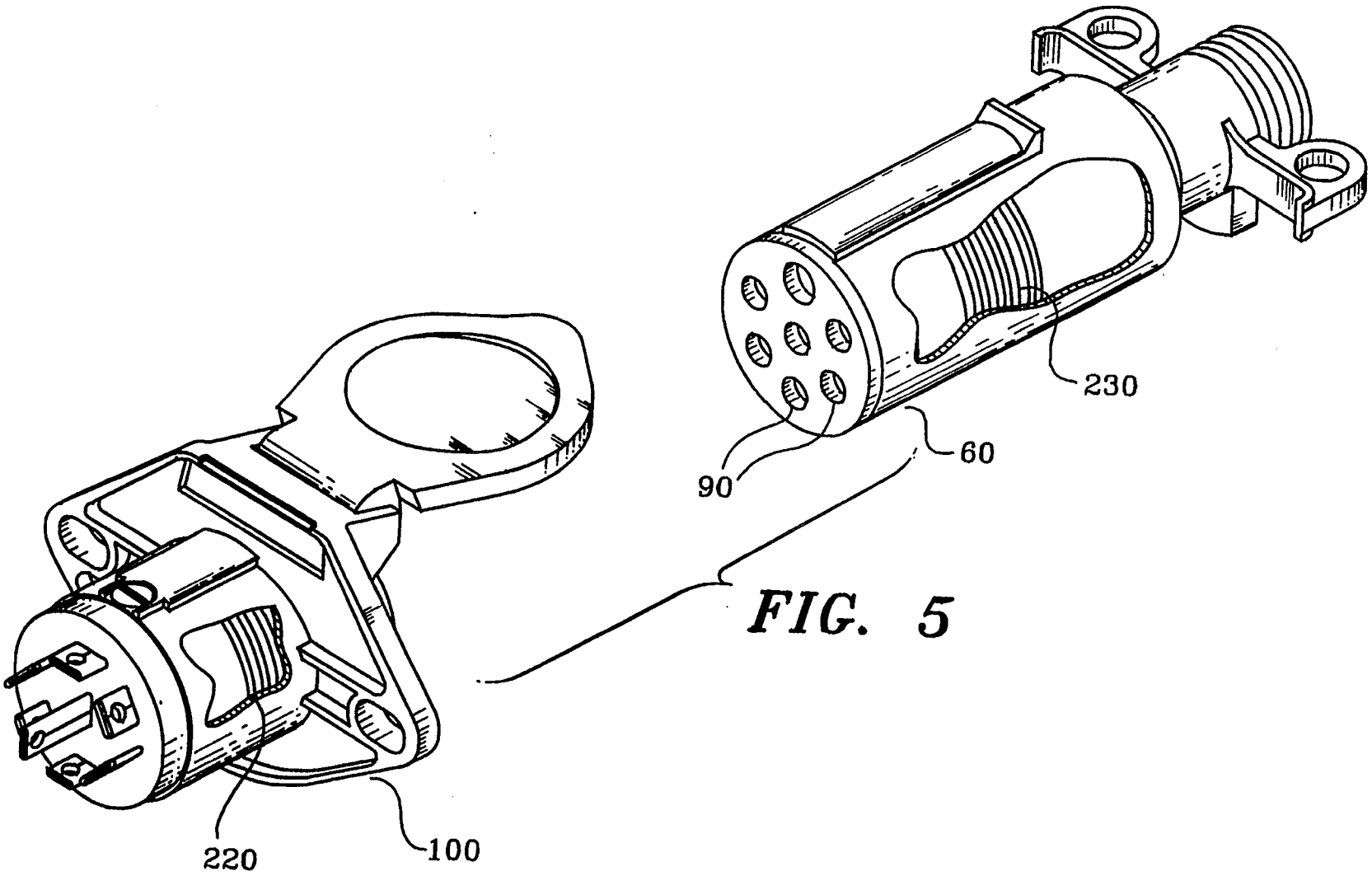
FIG. 5 is an isometric exploded view of a data communication connector provided in accordance with the present invention.

In accordance with the present invention, data communicating elements are interfaced in the J560 connector to carry data communication signals. Referring to FIG. 5, a connector provided in accordance with the present invention comprises second half 100, alternatively referred to throughout as "receptacle means" 100, generally for housing first electrical interface members 160, generally the pins (not shown in this view) that carry electrical signals output from the tractor to the trailer and receiving electrical signals output from the trailer to the tractor. "Plug means," the second half 60 of the J560 connector, is connectable to the receptacle means 100 for housing second electrical interface members 90, generally the receptacles 90 that carry electrical signals output from the trailer to the tractor and receiving electrical signals output from the tractor to the trailer.

A pair of air-core coils 220 and 230 are provided to the connector in preferred embodiments and particularly adapted to provide data communications between data-receiving devices and data-generating devices in the tractor and the trailer. It will be recognized by those with skill in the art that the data-receiving or producing devices can be either in the tractor or the trailer as is necessary for the particular application in which complicated data communication or transfer is necessary. This could be for example, ABS, computer-driven protection and warning devices, and any other device in the tractor or trailer which requires computers, and therefore data communication, in order to function.

Data is communicated to the first and second coils 220 and 230 in accordance with data communication protocols, and through the electromagnetic operation of the coils. In a preferred embodiment, a data signal produced from a data-producing device in the tractor/-trailer combination is interfaced to one of the two coils to set up in this first coil a magnetic field corresponding to data in a data signal. The magnetic field is then preferably communicated to the second coil which is adapted to receive the magnetic field and to have induced in it a voltage corresponding to the data in the data signal. The voltage is then bussed to a data receiving device in the tractor/trailer combination so that data can be effectively communicated and used by the data-receiving device.

Figure 6:
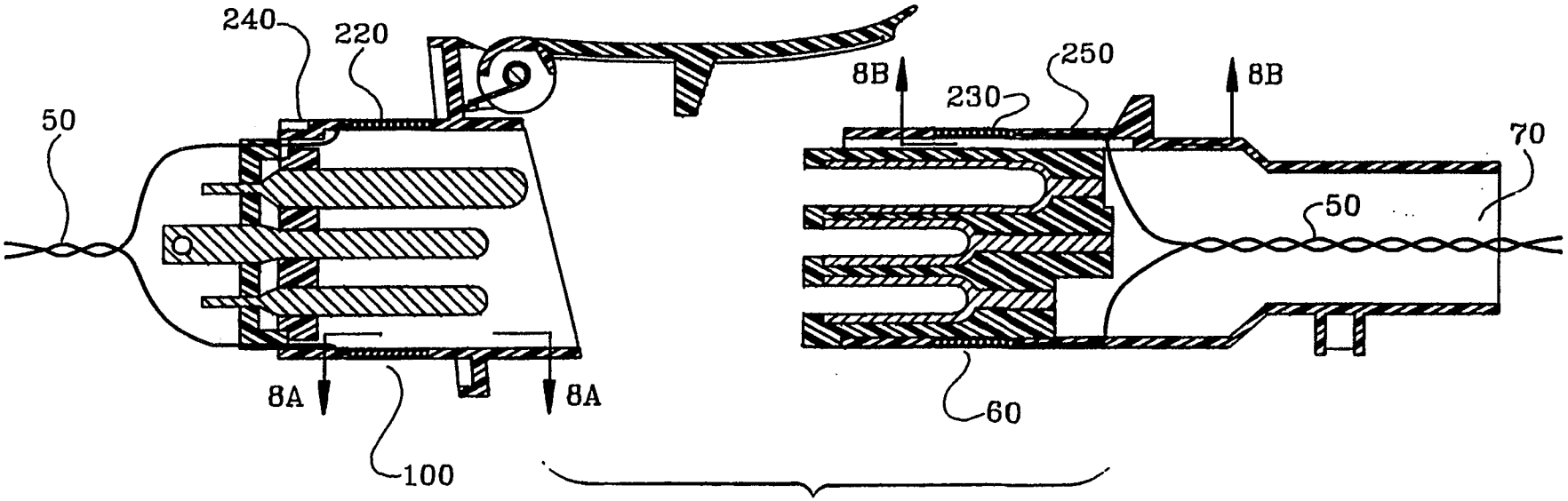
FIG. 6 is a cross-sectional view of a data communication connector provided in accordance with the present invention.

Referring now to FIG. 6, a cross-sectional view of a connector provided in accordance with the present invention having first and second coil means 220 and 230 is shown. The first coil means 220 is mounted in the second half of an equivalent J560 connector by preferably winding the coil from wire in the outer surface 240 or "shell" of the second half 100. This is accomplished in further preferred embodiments by winding the first coil means 220 around the outer surface 240 of receptacle end 100 while the receptacle end is injection molded out of a plastic material. In this fashion, first coil means 220 will be embedded within the outer surface or shell 240 of receptacle end 100 to form a continuous coil capable of magnetically communicating data through the receptacle end 100. The first coil means 220 will have a number of "turns," as is generally found in electromagnetic coils and which will be appropriate for the particular data communication applications to be implemented in the tractor/trailer combination.

Interfaced to the first coil means 220 is the communication line 50 which in preferred embodiments is a "twisted pair" cable. It will be recognized by those with skill in the art that other communication cables such as coaxial cables, twin axial cables and others, could be used to bus the data communication signals back and forth. In the first half 60, that is the plug end of the connector, the second coil means 230 is similarly wound in the outer surface or shell 250 of first half 60 and interfaced to a twisted pair 50 or other communication line as substantially described above which is fed through end 70 from the trailer. Second coil means 230 has a similar number of turns appropriate for the particular application in which the modified J560 connector in accordance with the present invention is to be used.

Figure 7:
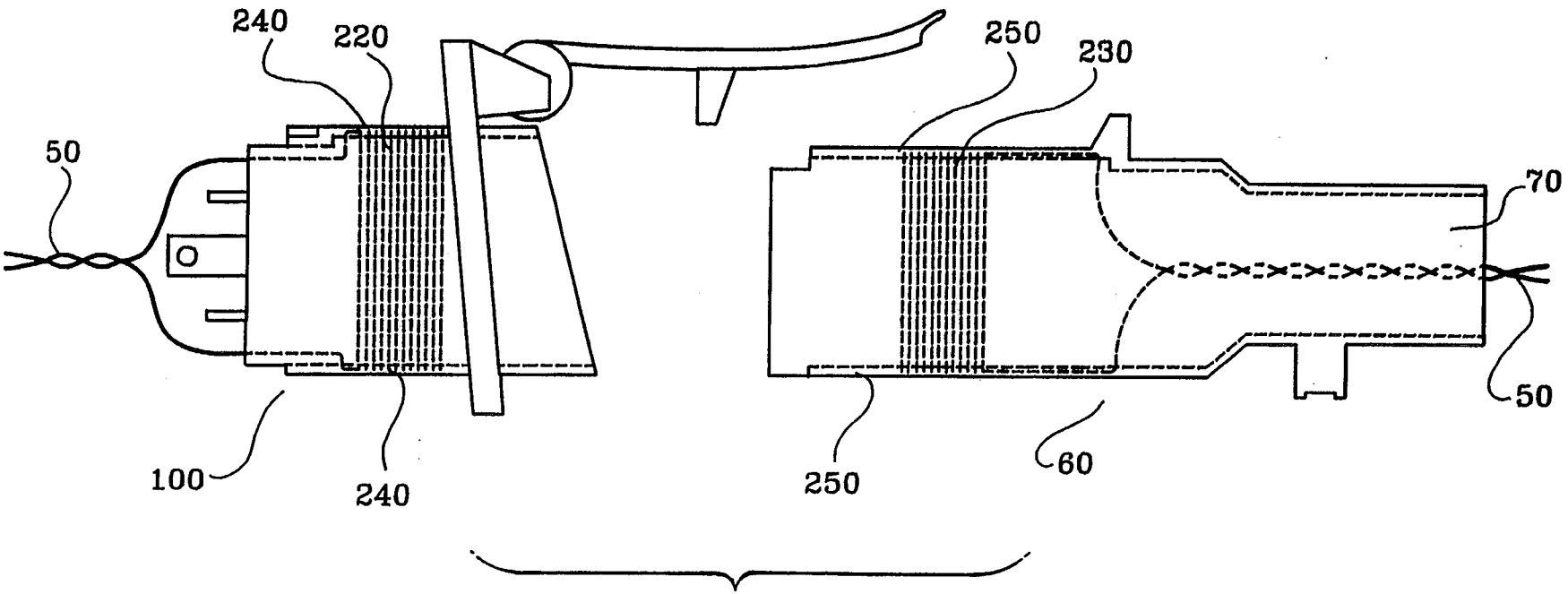
FIG. 7 is a further view of a data communication device provided in accordance with the present invention illustrating magnetically coupled coils.
Figure 8A:
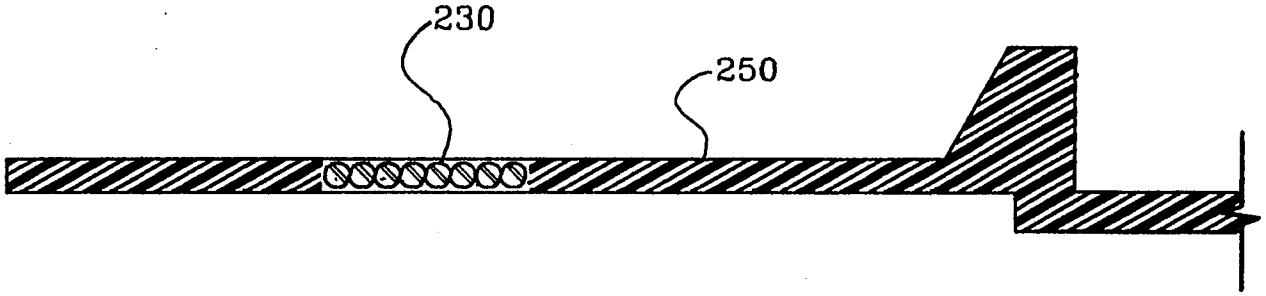
FIGS. 8A and 8B are cross-sectional views of the data communication connector provided in accordance with the present invention taken along the 8A and 8B lines of FIG. 6 respectively.
Figure 8B:
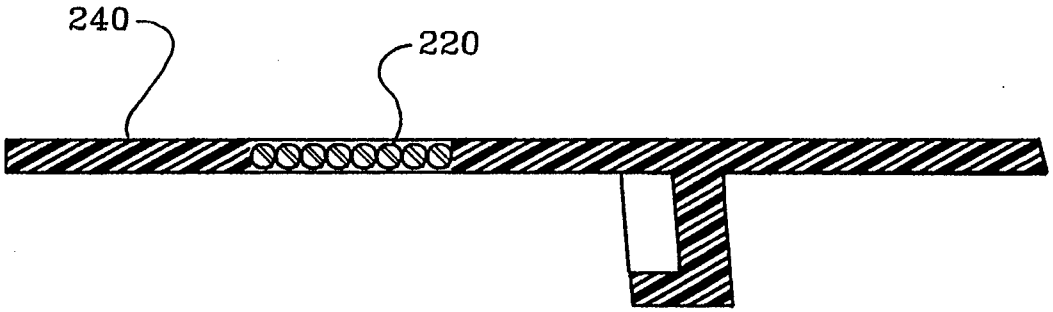

The embedded coils 220 and 230 are better seen in FIG. 7. The coils are wound or otherwise embedded in the shells or outer surfaces 240 and 250 of the first and second halves 60 and 100 respectively. In FIGS. 8A and 8B the outer surfaces or shells 240 and 250 are illustrated to show the individual windings of the coils 220 and 230 embedded respectively therein. As mentioned above, the coils 220 and 230 are wound in the outer shells 240 and 250 when the first and second halves 60 and 100 are injection molded or otherwise formed from a plastic material. In this fashion, the coils are permanently mounted in the connector to ensure accurate data communication and transmission.

Figure 9:
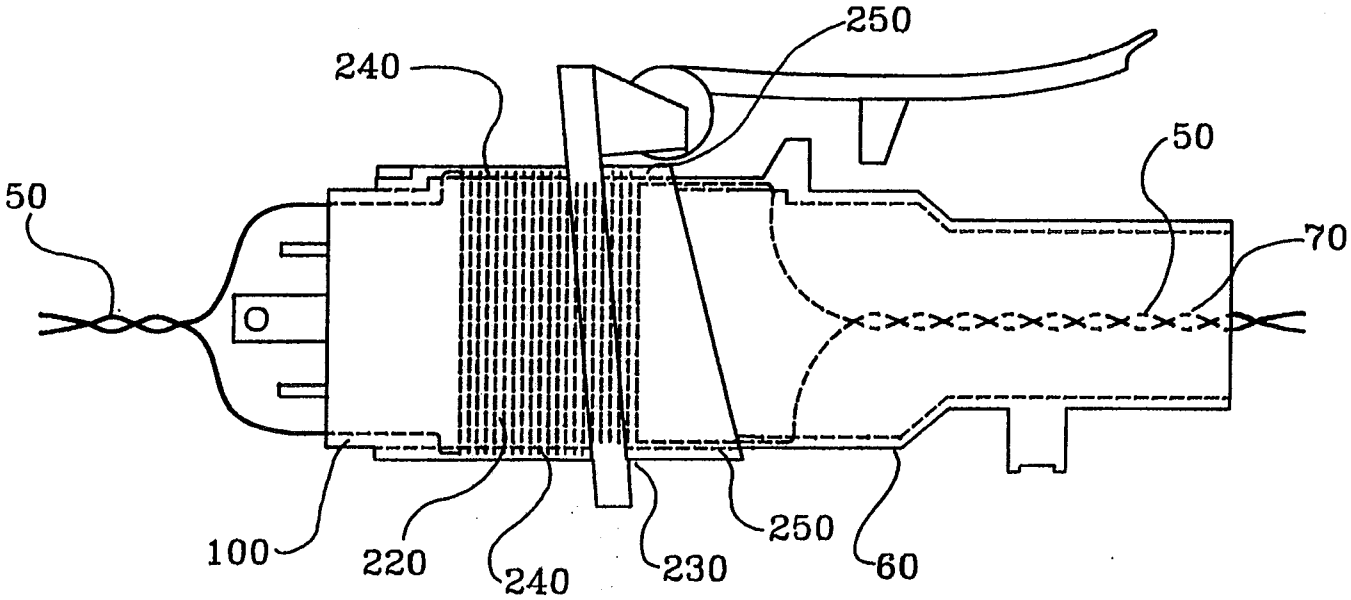
FIG. 9 is a view of the data communication connector provided in accordance with the present invention having first and second halves mated together.

When the first and second halves 60 and 100 are joined together as best shown in FIG. 9, data communication through the connector is possible by inducing voltages in the coils as substantially described above.

Thus, the coils 220 and 230 act in a transformer arrangement as the primary and secondary windings of a transformer respectively. When the J560 connector having a transformer communication coil arrangement in accordance with the present invention is formed, a communications protocol will preferably be generated by a computer and will be bussed along the twisted pair 50 to the first and second coils. The communications protocol will further preferably be a digital communications protocol adapted to communicate data between data producing and receiving devices in the tractor/trailer combination.

The transformer communications described herein are versatile, and have the ability to monitor a plurality of signals of a first device and convey the time domain multiplexed data to a second device. Additionally, frequency domain multiplexing is also possible with magnetic connectors provided in accordance with the present invention. Thus, the multiplexing transformer arrangement provided in accordance with the present invention is effective to support tractor/trailer combinations having a plurality of data communication needs. Furthermore, this transformer arrangement is easily integrated in standard J560 connectors so that the trucking industry can readily maintain this standard while adopting data communications in accordance with the present invention for future uses. These results have not heretofore been achieved in the art and provide significant advantages over standard J560 connectors and other connectors which are limited to bussing power between a tractor and a trailer.

The connectors and magnetic circuits provided in accordance with the present invention thus provide data links between tractors and trailers, and other systems. The connectors perform at data rates up to and including 125,000 bits per second in a standard asynchronous serial format. However, the connectors could also be used at lower data rates or with other protocols and formats. Additionally, other encoding technologies could be utilized in protocols such as, for example, frequency modulation (FM).

Various implementations of the magnetic connectors described herein are also possible, particularly in a tractor/trailer combination. The circuits can be configured with a single twisted pair cable connection, or in configurations which require a multiplicity of magnetic connectors with variable length twisted pair cables. It should also be noted that the magnetic coupling coefficient of connectors provided in accordance with the present invention is sufficient to support back-to-back connections of two of the connectors without intervening electronics.

Figure 10:
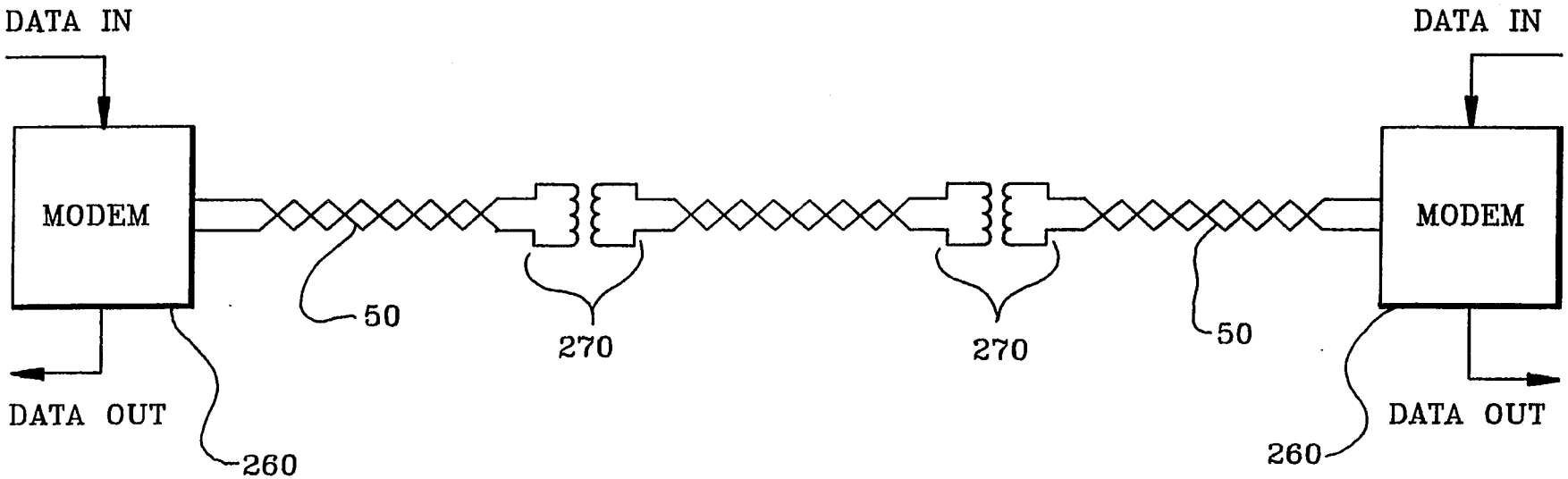
FIG. 10 is a schematic of data communication devices provided in accordance with the present invention.

As shown in FIG. 10, a system which employs magnetic connectors provided in accordance with the present invention will utilize a pair of modulator/demodulator (MODEM) circuits shown generally at 260, a pair of magnetic connectors provided in accordance with the present invention shown schematically at 270, and up to three application variant lengths of twisted pair transmission lines 50. In a preferred embodiment, a data waveform is impressed upon a 2.5 MHz sine wave carrier by amplitude modulation (AM). The modulation is preferably carried out such that a low level data bit referred to as a "space condition" results in full amplitude transmission, while a high level or "mark condition" results in a zero amplitude transmission. Demodulation of the data is preferably accomplished by the commonly known technique called "diode detection" wherein the modulated carrier is passed through a half-wave receiver circuit which acts as a low pass filter such that the high frequency carrier is blocked, leaving the low frequency data to pass through the circuit. While in preferred embodiments AM has been used to encode the data, other encoding techniques will be readily usable, and those with skill in the art will be able to readily execute such techniques with circuits provided in accordance with the present invention.

Figures 11A, 11B, 11C:
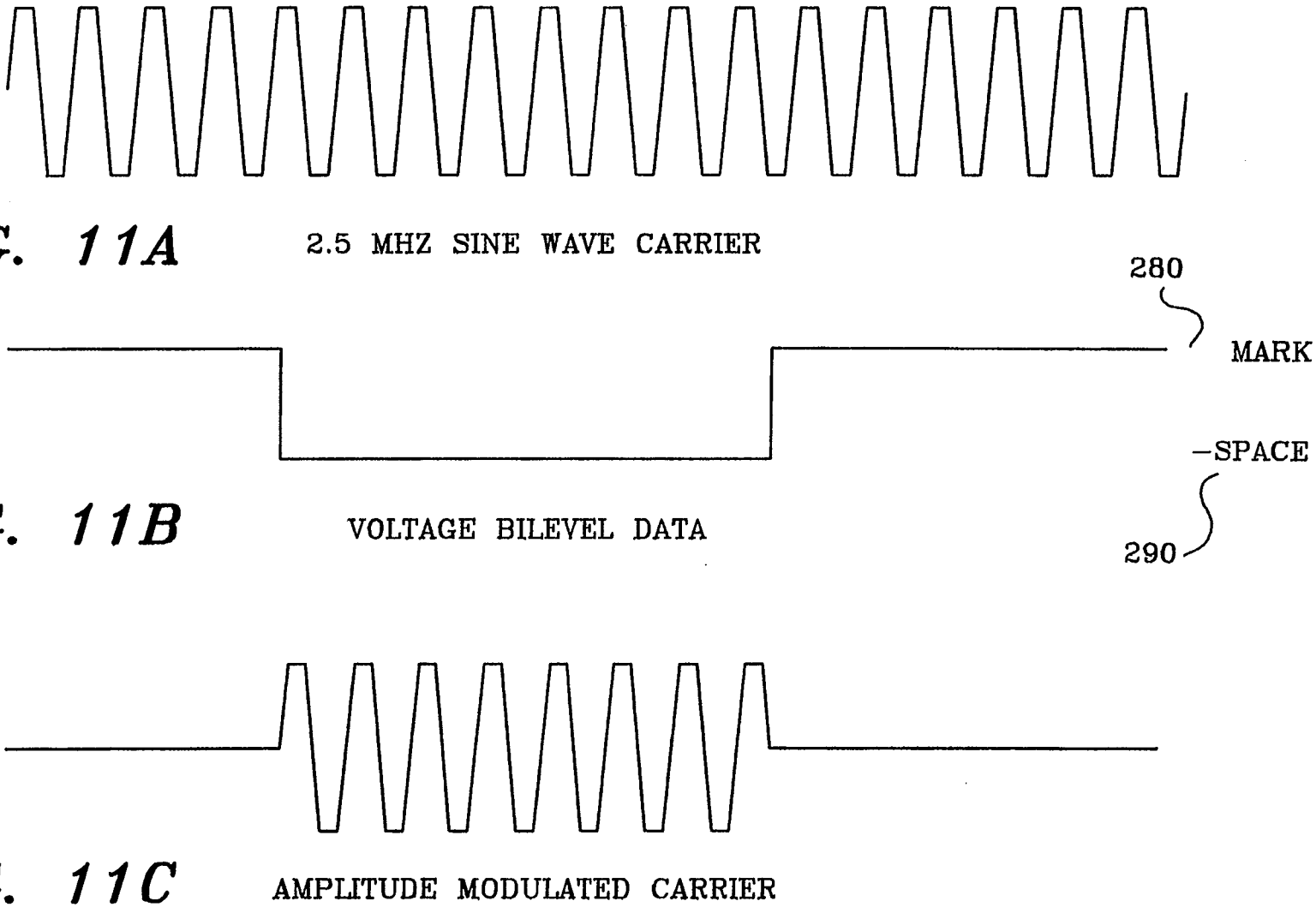
FIGS. 11A–11C are wave diagrams illustrating communication protocol for use in a data communication device provided in accordance with the present invention

Referring to FIGS. 11A through 11C, the AM technique used with the present invention is illustrated. FIG. 11A shows the 2.5 MHz sine wave carrier which carries the data. FIG. 11b shows the modulating voltage bi-level data signal wherein the mark or high level data bit 280 results in zero amplitude transmission, and the space or low level data bit 290 results in full amplitude transmission. The amplitude modulated carrier signal is shown in FIG. 11C. Thus, magnetic connectors in accordance with the present invention establish bi-directional, voltage bi-level communications across a standard seven-pin connector interface.

Figure 12A:
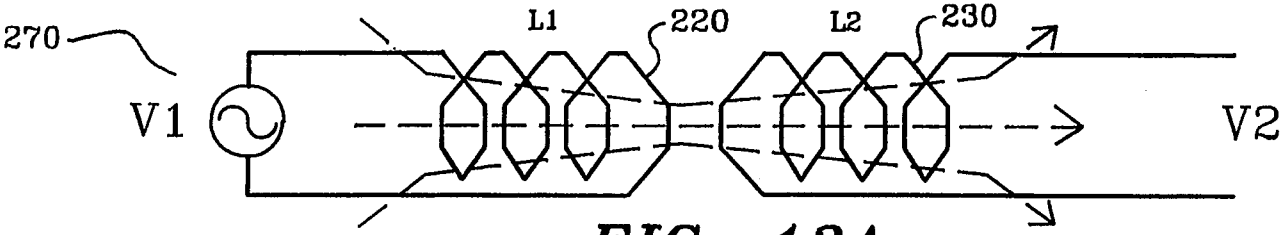
FIGS. 12A–12D are schematics of data communication connectors provided in accordance with the present invention and equivalent circuits thereof.
Figure 12B:
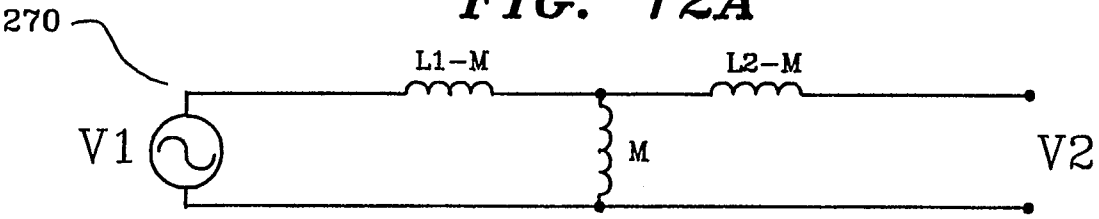
Figure 12C:
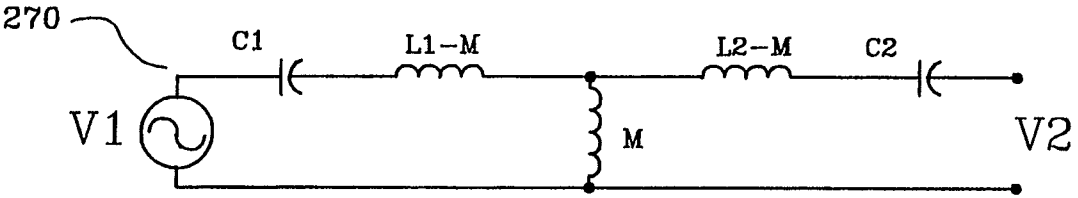

Referring to FIGS. 12A through 12D, schematics of the magnetically coupled coils which form connectors provided in accordance with the present invention and equivalent circuit models for the connectors are shown. As mentioned above, the circuits are magnetic in nature and thus operate on the principle of mutual magnetic coupling known to those with skill in the art. As shown in FIG. 12A, the connector 270 consists of two multi-turn coils 220 and 230 made of conducting wire which are brought into close but non-contacting proximity. A time variant voltage ($V_1$) modulated by the information to be conveyed is applied across coil 220 which causes a time variant current to flow in coil 220 in accordance with the well known physical relationship: where $V_1$ is the applied voltage, L is the coil self-inductance, I is the current, and t is time.

The time variant current, I, through coil 220 causes a proportional time variant magnetic field to be set up parallel with and through the coil axis. This time variant magnetic field causes a time variant voltage to be induced in the second coil 230 in close proximity to first coil 220 in accordance with the well known magnetically induced voltage law:

$$V_2 = -N \cdot d\phi/dt,$$

where N is the number of turns in coil 230, and $\phi$ is the magnetic flux from the first coil passing through the area enclosed by the turns, N, of the second coil.

When coils 220 and 230 are perfectly coincident such that all the flux generated by coil 220 passes through the second coil 230, the system is referred to as an "ideal transformer." In this case, the voltage impressed upon coil 230 is reproduced through the second coil 230 in direct proportion to the ratio of turns of the two coils.

However, when the two coils 220 and 230 are not perfectly coincident, some of the flux generated by coil 220 does not pass through the second coil 230. The voltage induced in coil 230 is thus less than that given by the turns ratio of the coils. The portion of coil 220's self-inductance which is not mutually coupled to coil 230 is referred to as the system's "leakage inductance" and represents a loss term in the network analysis. In this situation, and referring to FIG. 12B, the two magnetically coupled coils 220 and 230 may be modelled by the equivalent circuit shown. In this circuit, "M" represents the mutual or shared inductance of the two coils while $L_1-M$ and $L_2-M$ represent the leakage or non-shared inductance of coils 220 and 230 respectively.

Figure 12D:
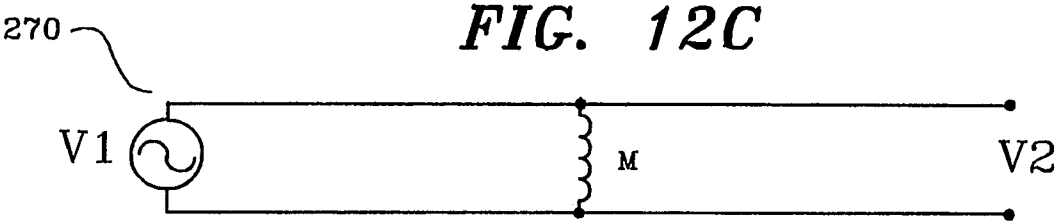

In order to minimize the signal loss at the output $V_2$due to the voltage drop across the leakage inductance, the two leakage components are preferably reactively tuned out at the carrier frequency by the addition of series capacitances, $C_1$ and $C_2$, on each coil 220 and 230 respectively. The capacitance values $C_1$ and $C_2$ should be chosen so that the resulting resonance of the series capacitance and inductance combinations will result in the leakage being removed from the equivalent circuit. Thus as shown in FIG. 12D, all the signal voltage $V_1$ applied to coil 220 will be reproduced across coil 230 as voltage $V_2$. Naturally, there will be resistive loss components which are not shown in this circuit model which will also result in signal losses which cannot be tuned out. Consequently, there will always be a resistive loss of signal amplitude in this circuit.

The circuit schematic and equivalent circuit models of FIGS. 12A through 12D illustrate a preferred embodiment wherein coils 220 and 230 are mated concentrically rather than end to end. In more preferred embodiments, the industry standard J560 seven-pin connection will have coils 220 and 230 embedded in each connector half such that when the halves are mated, the coils will be aligned and concentric. Prototype designs of this preferred embodiment have yielded magnetic coupling coefficients in excess of 60% under conditions of optimum coil alignment.

Coils 220 and 230 were wound using 30 gauge enamel insulated, solid copper wire to achieve equal self-inductance in coils 220 and 230. This produces an inductance of 25.5 $\mu$H wherein an inner coil, preferably coil 220, requires 21 turns, and the outer coil, preferably coil 230, requires 18 turns. Since the mutual inductance M is the same for both coils 220 and 230, the leakage inductances $L_1-M$ and $L_2-M$, are also equal.

With a 65% coupling coefficient, the leakage inductance is given by:

$$L_1-M=L_2-M=(1.00-0.65)\cdot 25.5\ \mu H=8.9\ \mu H.$$

This leakage inductance is tuned out at the carrier frequency with the addition of resonant capacitances of 455 pF in series with each coil. The reactance of the remaining mutual inductance, $X_M$, is substantially 260 Ω and the loss resistance associated with each coil is on the order of about 13 Ω.

It is apparent that the connector housing or outer shells 240 or 250 must of necessity be made of an electrically non-conductive material. The time variant magnetic field of coils 220 and 230 will induce eddy currents in any adjacent conductive materials, and the finite resistance of the materials under the influence of these currents will represent a large loss component in the system. Since the seven-pin contact assemblies of the standard J560 seven-pin connectors are highly conductive, they could be expected to contribute significantly to the loss component. However, it has been found that the loss due to the seven-pin contact assemblies is insubstantial. Furthermore, since the outer shells 240 and 250 will preferably be injection molded from glass-nylon which is not substantially conductive, no loss component will be introduced from the outer shells.

It is also apparent that the length of twisted pair cables 50 will exhibit distributed circuit characteristics of electrical transmission lines when the cable length approaches 1/16 of the electrical wave length. The wave length of a 2.5 MHz carrier is 394 feet, and so the transmission line effects will be observed in any length of twisted pair cable in excess of about 25 feet. Since cable lengths in excess of 90 feet are anticipated in tractor/trailer combinations, transmission line practices must be employed.

A transmission line which is not terminated by an impedance equal to its own characteristic impedance will exhibit reflections of an applied incident voltage waveform. The reflected wave will in turn set up a voltage standing wave pattern wherein the peak voltage goes off from a maximum as the distance from the voltage source is increased. The voltage standing wave pattern amplitude will drop off to a minimum at a distance equal to about $\frac{1}{4}$ of the wave length from the source, and rise to a maximum again at about half the wave length from the source, where the wave will repeat itself. Thus a system which exhibits a substantial standing wave pattern will require custom calibration of MODEMS 260 for each configuration of transmission line length. In order to minimize the effect of standing wave patterns on transmission signal amplitude for the entire range of applicable transmission lengths, the MODEMS must present an input and output impedance as closely matched as possible to the characteristic impedance of the twisted pair cable. In preferred embodiments, the characteristic impedance of twisted pair cable 50 will be about 120 Ω.

It is equally important that the reactance of the mutual coil inductance be insignificant compared to the characteristic impedance of the cable or the terminal impedance will no longer match the cable characteristic impedance. The reactance of the mutual inductance of prototype connectors tested in accordance with the present invention was about 260 Ω, which was about twice the characteristic impedance of the cable. This is not an insignificant reactance, however, by increasing the number of turns in the coils, thus the mutual inductance and reactances, resistive loss components are introduced to the system which themselves become significant compared to the characteristic impedance. The selection of coil inductance should therefore be based upon an optimization of signal amplitude between the divergent effects of mutual reactance and the cable termination and reactive loss components in the coil assemblies.

The mutual reactance and resistive loss effects become pronounced with an increase in carrier frequency, that is, the transmission line effects become increasingly influential with increasing frequency at ever shorter cable lengths. Similarly, resistive loss components become substantially more pronounced as a result of the higher frequency magnetic properties of the materials. However, demodulation of the data signal is a relatively simple process if the carrier frequency is several orders of magnitude higher than the data frequency, but will become more complicated as the two frequencies approach one another. The selection of the carrier frequency should be based on an optimization of the cost, complexity and performance between the divergent effects of frequency on demodulation, and magnetic physics and transmission line effects.

Seven-pin connectors and magnetic circuits provided in accordance with the present invention allow the interconnection of intelligent computer systems on tractor trailers and other devices requiring data communication. Since prior J560 connector assemblies are routinely subjected to the harshest environmental conditions, including temperature extremes, severe vibration, dirt and corrosive atmospheres, it is not uncommon to find that dirt buildup and/or loosening of the contacts from prolonged excessive vibration in the current seven pins have reduced the integrity of the connection to the point where subsystems on the tractor/trailer are non-functional. Furthermore, oxidation of connector contacts is expected which is usually counteracted by the high currents passed through the seven pins. However, no such elevated currents are present in a datalink so that oxidation buildup would be expected over time to cause a significant degradation of signal integrity if data were bussed over one of the seven pins. The advantage of magnetic circuits provided in accordance with the present invention will be recognized by those with skill in the art since no contacts are employed, and no oxidation and dirt buildup will then cause any signal degradation.

Data communications with magnetic circuits provided in accordance with the present invention are also immune to the effects of extreme vibration, since efficient magnetic coupling is maintained as long as the connector plugs are properly seated in the receptacles. Tests on prototype connectors have shown that the plugs may be withdrawn from the receptacles in excess of one-half inch before communications are interrupted. Furthermore, magnetic circuits provided in accordance with the present invention are inherently differential, and so the isolation afforded by the magnetic coupling provides a high degree of immunity to common mode noise and voltage drops in ground circuitry. The voltage induced in coil 230 depends almost entirely upon the voltage difference impressed across coil 220 without regard to any ground reference.

The connectors 270 described herein are essentially radio frequency (RF) datalinks with data signals constrained to a twisted pair. These connectors avoid the problems associated with wireless RF datalinks, namely differentiating between valid network nodes and those of another network in close proximity, and lower data throughput rates resulting from bandwidth limitations of the carrier frequency. In this fashion, connectors provided in accordance with the present invention maintain strictly point-to-point communications at all times. Furthermore, finally, since the coils are embedded in the connector housings or outer shells 240 and 250, they are not exposed to corrosive elements which may be present.

There have thus been described certain preferred embodiments of magnetic circuits for multiplexing data in a tractor/trailer combination. While preferred embodiments have been described and disclosed, it will be recognized by those with skill in the art that modifications are within the true spirit and scope of the invention. The appended claims are intended to cover all such modifications.

What is claimed is:

1. An electrical connector for transferring multiple electrical signals from one cable on a trailer to another cable on a tractor of a tractor/trailer combination, comprising:

a multi-pin plug;

a multi-receptacle socket matable with said plug;

said plug comprising a plurality of pins, a first non-ferrous shell surrounding said pins, and a first air-core coil carried on said first shell;

said socket comprising a second non-ferrous shell surrounding said receptacles, and a second air-core coil carried on said second shell;

said first and second air-core coils being positioned adjacent to each other to form an air-core transformer when said plug and socket are mated; and means for delivering high-frequency information-bearing electrical signals to at least one of said first and second air-core coils for magnetic transfer to the other of said first and second air-core coils by air-core transformer action.

2. The connector of claim 1, wherein said first and second air-core coils and said first and second shells are substantially coaxial with each other.

3. The connector of claim 2, wherein one of said first and second air-core coils is within the other and coaxial therewith.

4. In an electrical system for a tractor/trailer combination, comprising a first and a second multi-conductor cable joined to each other by a connector, said connector having one part which comprises a multi-pin plug containing a plurality of pins and another part which is a multi-receptacle socket containing a plurality of receptacles matable with said pins, said first electrical cable being adapted to supply electrical power to said connector from said tractor and said second electrical cable being adapted to receive said power from said first electrical cable by way of said plug and socket, the improvement wherein:

said plug comprises a non-ferrous first shell surrounding said pins, and a first air-core coil carried on said first shell;

said socket comprises a second non-ferrous shell surrounding said receptacles and a second air-core coil carried on said second outer shell;

said first and second air-core coils being positioned so as to form an air-core transformer when said connector parts are mated; and means for supplying at least one of said coils with high-frequency information-bearing signals for magnetic transfer to the other of said coils through said air-core transformer.

5. The system of claim 4, wherein said information-bearing signals comprise a radio-frequency carrier wave modulated with digital information.

6. The system of claim 4, wherein said radio-frequency carrier wave is amplitude modulated with digital information.

7. The system of claim 4, wherein said first and second air-core coils are coaxial with each other when said plug and said socket are mated with each other.

8. The system of claim 7, wherein said first and second air-core coils are positioned one within the other when said plug and said socket are mated with each other.

9. The system of claim 4, wherein said first air-core coil is embedded in said first shell, said second air-core coil is embedded in said second shell, and said shells are of non-ferrous material.

10. The system of claim 4, comprising leads secured to said first and second air-core coils and extending inside said first and second shells to said first and second cables.

11. The system of claim 4, wherein said pins are seven in number and said receptacles are also seven in number.

12. The system of claim 10, wherein said leads comprise two twisted pairs of leads, each extending from a different one of said air-core coils through its associated connector shell to its associated cable.

* * * * *